US006169467B1

(12) United States Patent
El-Sharawy

(10) Patent No.: US 6,169,467 B1
(45) Date of Patent: Jan. 2, 2001

(54) DIELECTRIC RESONATOR COMPRISING A DIELECTRIC RESONATOR DISK HAVING A HOLE

(76) Inventor: El-Badawy Amien El-Sharawy, 1434 E. Spur Ave., Gilbert, AZ (US) 85296

( * ) Notice: Under 35 U.S.C. 154(b), the term of this patent shall be extended for 0 days.

(21) Appl. No.: 09/215,856

(22) Filed: Dec. 18, 1998

Related U.S. Application Data

(63) Continuation-in-part of application No. 09/099,621, filed on Jun. 18, 1998, now abandoned.

(51) Int. Cl.[7] ..... H01P 7/10

(52) U.S. Cl. ..... 333/219.1; 333/222; 331/96; 331/107 DP

(58) Field of Search ..... 333/202, 208, 333/209, 219, 219.1, 222, 223, 224, 235, 227, 231, 232; 331/107 DP, 96

(56) References Cited

U.S. PATENT DOCUMENTS

| | | | | |
|---|---|---|---|---|
| 2,890,422 | | 6/1959 | Schlicke | 333/219.1 |
| 3,798,578 | * | 3/1974 | Konishi et al. | 333/202 X |
| 4,521,746 | | 6/1985 | Hwan et al. | 331/96 |
| 4,668,925 | | 5/1987 | Towatari et al. | 333/219.1 |
| 4,706,052 | * | 11/1987 | Hattori et al. | 333/219.1 |
| 4,728,913 | | 3/1988 | Ishikawa et al. | 333/219.1 X |
| 4,835,498 | | 5/1989 | Rouger et al. | 333/219.1 X |
| 5,325,077 | | 6/1994 | Ishikawa et al. | 333/219.1 |
| 5,859,574 | * | 1/1999 | Schmitt | 333/202 |

FOREIGN PATENT DOCUMENTS

| | | | | |
|---|---|---|---|---|
| 0 492 304 A1 | * | 7/1992 | (EP) | 333/235 |
| 60-98703 | | 6/1985 | (JP) | 333/202 |

OTHER PUBLICATIONS

Cheng–Chyi You, Chen–Liang Huang and Chung–Chuang Wei, "Single–Block Ceramic Microwave Bandpass Filters", The Microwave Journal, Nov. 1994, pp. 24–35.

Trans–Tech, Inc., "Dielectric Resonators and Related Products—A Designer's Guide to Microwave Dielectric Ceramics", Apr. 1993.

* cited by examiner

*Primary Examiner*—Robert Pascal
*Assistant Examiner*—Barbara Summons
(74) *Attorney, Agent, or Firm*—Meschkow & Gresham, P.L.C; Jordan Meschkow; Lowell W. Gresham

(57) ABSTRACT

A $TE_{0\gamma\delta}$ mode dielectric resonator (12) includes a cylindrical dielectric disk (32, 32', 32") having top and bottom ends (20, 22) spaced apart by a closed curve wall (24). The dielectric disk has an effective dielectric constant greater than 40. An axially aligned hole (36) is formed through the disk (32) between the top and bottom ends (20, 22). A conductive wall (34, 34") is formed at or slightly beyond the wall (24) but does not cover the top and bottom ends (20, 22). The hole (36) has a preferred diameter between 0.21 and 0.4 times the diameter of the disk (32, 32', 32"). The disk may be configured as a heterogeneous composite of dissimilar materials which exhibit increasing dielectric constant at increasing radial distance and increasing Q at decreasing radial distance.

21 Claims, 5 Drawing Sheets

DIELECTRIC RESONATOR COMPRISING A DIELECTRIC RESONATOR DISK HAVING A HOLE

RELATED INVENTION

The present invention is a continuation in part (CIP) of "$TE_{0\gamma\delta}$ MODE DIELECTRIC RESONATOR," U.S. patent application Ser. No. 09/099,621, filed June 18, 1998, now abandoned, which is incorporated by reference herein.

TECHNICAL FIELD OF THE INVENTION

The present invention relates to radio frequency (RF) communications and to resonators used in RF communication equipment. More specifically, the present invention relates to dielectric resonators.

BACKGROUND OF THE INVENTION

Resonators are useful in RF communication equipment in connection with filters, low noise oscillators, and other circuits. When a resonator with a resonant frequency in the UHF-band (i.e.<1.0 GHz) is needed, surface acoustic wave (SAW) technology provides a beneficial solution. In the UHF-band, SAW resonators are relatively small and exhibit a suitably high quality factor (Q). Unfortunately, as frequencies approach the top of the UHF-band, the resulting quality factor for SAW resonators deteriorates, and SAW resonators are usually impractical for resonant frequencies above the UHF-band.

Dielectric resonators may be used to achieve resonant frequencies at the top of the UHF-band and above. Dielectric resonators are smaller than air cavity resonators having equivalent resonant frequencies because wavelength in the dielectric resonator is divided by the square root of the resonator's dielectric constant. In addition, reactive power is not stored strictly inside the dielectric resonator, and fractional modes of resonance are exhibited. As resonant frequencies become higher, the size of the dielectric resonator becomes smaller.

Unfortunately, in the UHF-band, L-band (i.e. 1.0–2.0 GHz) and S-band (i.e. 2.0–4.0 GHz), conventional dielectric resonators are still often undesirably large or exhibit an undesirably low quality factor (Q). This frequency range is used by numerous portable RF communication devices, such as cellular and other telephones. Portable RF communication devices differ from other types of RF communication devices because of a heightened need to consume as little power as possible and to be as small and lightweight as possible. The minimal power consumption need results from portable devices being energized by batteries, and the size and weight are important because such devices are often designed to be carried on the persons of the users of the devices. Unfortunately, a resonator having a low quality factor can cause excessive power consumption, while a resonator that is too large can unnecessarily increase the size and weight of a portable device.

As an example, a conventional cylindrical $TE_{01\delta}$ mode dielectric resonator, where "δ" indicates a fraction of periodicity in the "Z" direction, having a dielectric constant of around 80 and a lowest resonant frequency of around 1.8 GHz has a diameter of around 2.0 cm and an axial length of around 0.8 cm. The use of a component of such large size and corresponding large weight is highly undesirable in a portable RF communication device. Moreover, even with a conductive cavity surrounding the resonator that further increases size, such a resonator exhibits an undesirably low Q. $TM_{01\delta}$ mode and other conventional TE and TM mode dielectric resonators tend to be even larger and/or exhibit lower Q.

A conventional practice in connection with dielectric resonators, such as the above-discussed $TE_{01\delta}$ mode and $TM_{01\delta}$ dielectric resonators, is to form a small, axially aligned hole through a cylindrical dielectric resonator. The hole serves two functions. It further separates the lowest resonant frequency from the next lowest resonant mode, and it allows the resonator to be mounted using a dielectric screw having a low dielectric constant. The hole has as small a diameter as possible to accommodate a screw large enough to securely mount a given resonator. The use of a hole no larger than necessary to meet mechanical mounting requirements does not significantly influence the performance of the resonator in the lowest resonant frequency mode. Conventionally, a hole less than 0.21 times the resonator's diameter achieves this purpose for resonators having a lowest resonant frequency in the 0.3–6.0 GHz range. However, as the hole size increases relative to the diameter of the resonator, a given resonator risks a deteriorating quality factor and larger overall size.

Another conventional practice in connection with dielectric resonators is to place the resonators within a conductive housing. Conductive walls of the housing influence the performance of the resonator, typically by lowering the resonant frequency and raising the Q as the conductive walls are placed farther from the dielectric resonator. Unfortunately, this practice only makes the resonators that much larger for a given lowest resonant frequency. A conventional $TE_{01\delta}$ mode resonator that employs a conductive housing has a minimum radius of $0.8\lambda/\sqrt{\epsilon_r}$, where $\epsilon_r$ is the dielectric constant of the dielectric resonator. A conventional $TM_{01\delta}$ mode resonator that employs a conductive housing has a minimum radius of $0.75\lambda/\sqrt{\epsilon_r}$. Moreover the formation of a small, axially aligned hole through a cylindrical dielectric resonator configured for the $TM_{01\delta}$ mode forces the resulting structure to be even larger for the same lowest resonant frequency.

SUMMARY OF THE INVENTION

Accordingly, it is an advantage of the present invention that an improved dielectric resonator is provided.

Another advantage of the present invention is that a $TE_{0\gamma\delta}$ mode dielectric resonator is provided which achieves suitably high Q in a smaller space than is required by conventional $TE_{01\delta}$ mode or $TM_{01\delta}$ mode dielectric resonators.

Another advantage of the present invention is that a relatively large hole in a cylindrical dielectric resonator, preferably greater than 0.21 times the diameter of the resonator, and a conductive wall cause a fractional resonant mode in the radial direction.

Another advantage of the present invention is that a composite dielectric resonator is provided which, given a desired oscillation mode, increases Q while reducing resonator diameter.

The above and other advantages of the present invention are carried out in one form by a resonator configured to resonate in the $TE_{0\gamma\delta}$ mode at a lowest resonant frequency having a wavelength $\lambda$ in empty space. The resonator includes a dielectric resonator disk configured to exhibit an effective dielectric constant $\epsilon_{re}$. The disk has first and second opposing ends along an axis of the disk and a closed curve wall surrounding the disk axis and extending between the first and second ends. The disk has a hole penetrating therein from the first disk end and extending toward the second disk end, wherein at least one of the first and second ends serves as a boundary between the disk and a dielectric material having a dielectric constant less than $0.5\epsilon_{re}$. A conductive wall is juxtaposed with the curved wall of the disk and positioned less than $0.75\lambda/\sqrt{\epsilon_{re}}$ from the axis.

The above and other advantages of the present invention are carried out in another form by a resonator having a first dielectric resonator disk and a second dielectric resonator disk. The first dielectric resonator disk has a hole therein and is formed from a first material which exhibits a first dielectric constant and a first quality factor (Q). The second dielectric resonator disk is located inside the hole of the first dielectric resonator disk. The second disk is formed from a second material which exhibits a second dielectric constant and a second quality factor (Q).

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
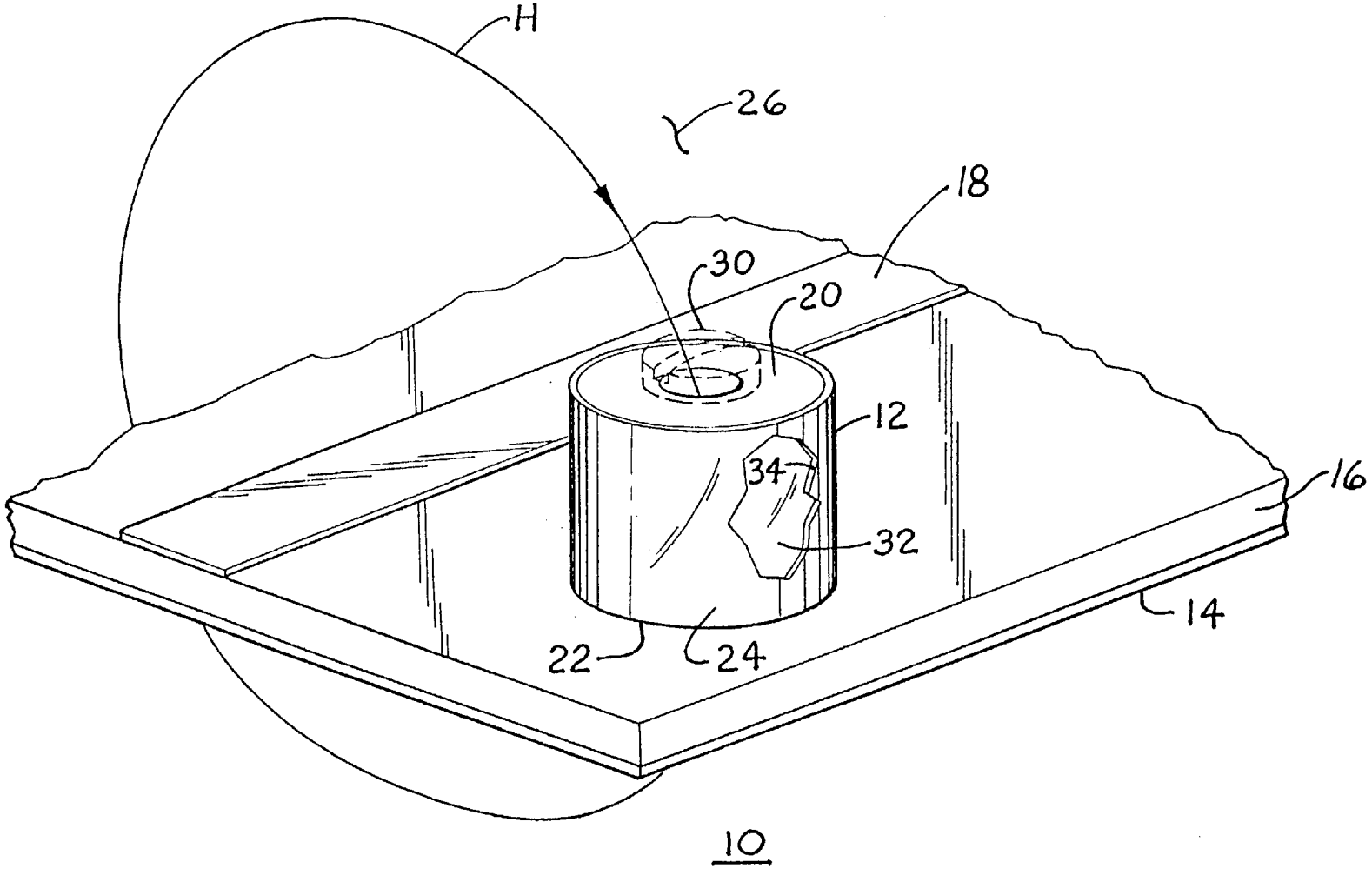
FIG. 1 shows a cut-away perspective view of a physical layout for a circuit which includes a $TE_{0\gamma\delta}$ mode dielectric resonator.

FIG. 1 shows a cut-away perspective view of a physical layout for a section of a circuit 10 which includes a $TE_{0\gamma\delta}$ mode dielectric resonator 12. Circuit 10 is a microstrip circuit, such as may be included in an oscillator or filter (not shown). Circuit 10 includes a conductive ground plane 14 underlying a dielectric substrate 16. A conductive microstrip trace 18 is clad to the side of substrate 16 that opposes ground plane 14.

Resonator 12 is preferably configured in a generally cylindrical or tubular geometry and has a top end 20 which opposes a bottom end 22 and is spaced apart from bottom end 22 by a distance defined by a closed curved wall 24 that extends between ends 20 and 22. Resonator 12 is mounted near trace 18 on the side of substrate 16 that carries trace 18. Bottom end 22 forms a boundary with substrate 16, and top end 20 forms a boundary with air 26. An axis of resonator 12 extends substantially perpendicular to substrate 16.

Resonator 12 may be mounted to substrate 16 using a suitable dielectric screw 30, shown in phantom, or using a suitable dielectric adhesive (not shown). Screw 30 may be formed from TEFLON® or another dielectric material which has similar mechanical properties and exhibits a low dielectric constant.

In the preferred embodiment, an electromagnetic signal having a frequency in the range of 0.3 to 6.0 GHz is impressed upon a transmission line formed from trace 18 and ground plane 14. While higher frequency signals may also be used, the beneficial size advantages of resonator 12 achieved for such higher frequencies are not as pronounced as in the preferred frequency range of 0.3 to 6.0 GHz. This signal produces a magnetic field having field lines surrounding trace 18, as designated by the letter H in FIG. 1. Due to the proximity of resonator 12 to trace 18 and to the orientation of resonator 12, magnetic field H is strongly coupled to resonator 12 in the tangential direction, which extends between top and bottom ends 20 and 22 of resonator 12.

Of course, those skilled in the art will appreciate that resonator 12 is not limited to being used in a microstrip circuit or to the precise manner of coupling discussed above. Rather, microstrip circuit 10 merely represents one of many possible useful circuits within which resonator 12 may be used.

Figure 2:
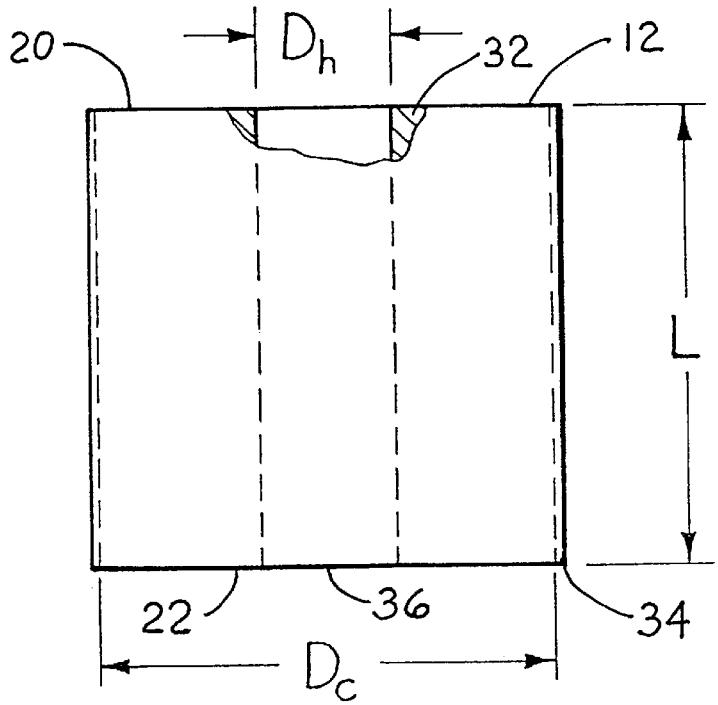
FIG. 2 shows a cut-away side view of the $TE_{0\gamma\delta}$ mode dielectric resonator.
Figure 3:
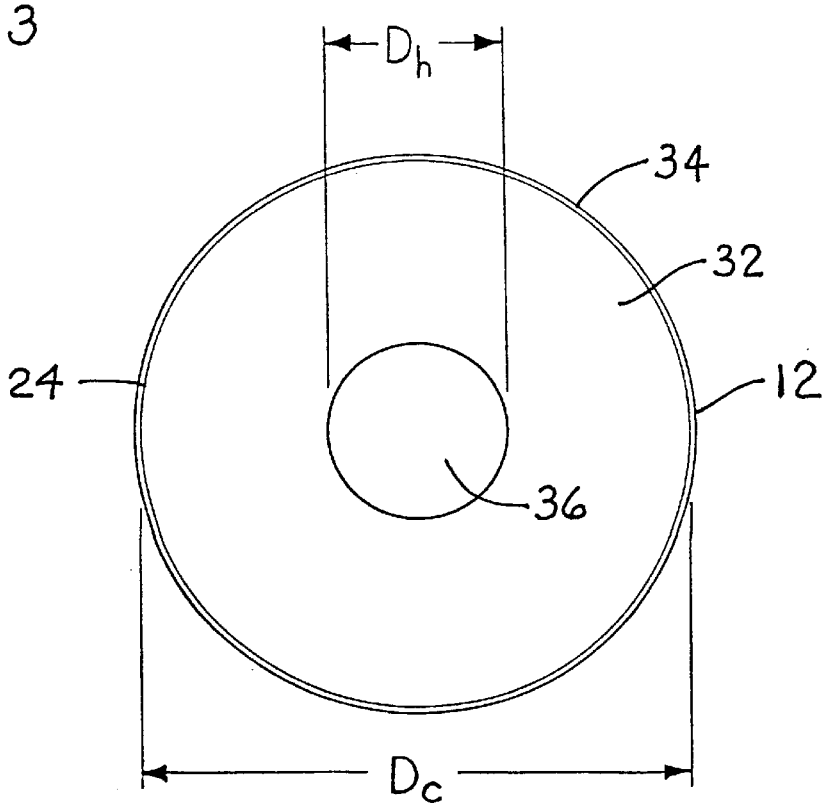
FIG. 3 shows a top view of the $TE_{0\gamma\delta}$ mode dielectric resonator.

FIG. 2 shows a side view and FIG. 3 shows a top view of a first embodiment of $TE_{0\gamma\delta}$ mode dielectric resonator 12. Referring to FIGS. 1–3, resonator 12 is configured to have a lowest resonant frequency at a fractional mode in both the radial and axial directions. The "γ" and "δ" subscripts in the $TE_{0\gamma\delta}$ mode designation represent fractional periodicities in radial and axial directions, respectively. In particular, resonator 12 is formed from a dielectric disk 32 and a conductive wall 34.

Disk 32 is formed from a substantially homogeneous dielectric material in this embodiment. The selected material preferably has a dielectric constant ($\epsilon_r$)>40 throughout disk 32. In addition, this material preferably exhibits an unloaded quality factor (Q)>3000 in the desired frequency range of 0.3–6.0 GHz. Materials having higher dielectric constants are more desirable than lower dielectric constants because such materials allow the dimensions of resonator 12 to shrink accordingly for a given resonant frequency. Likewise, materials having higher Q values are more desirable than lower Q value materials because higher Q values allow resonator 12 to exhibit a higher quality factor.

Accordingly, the dielectric material from which disk 32 is formed is selected to balance a high dielectric constant parameter against quality factor. One such material is commercially available from the Trans-Tech corporation of Adamstown, Md., USA, under the trade name: "8600 Series." This material is a ceramic composition substantially of Ba, lanthanides and Ti-oxide. However, other dielectric materials known to those skilled in the art which meet the desired dielectric constant and quality factor criteria may be used as well.

Conductive wall 34, is desirably a highly conductive material, such as copper, silver or gold. In the preferred embodiment, conductive wall 34 is a coating that is applied to closed curve wall 24 of resonator 12 so that it substantially entirely covers wall 24, but conductive wall 34 desirably does not cover a significant portion of either top or bottom ends 20 and 22. In alternate embodiments discussed below, conductive wall 34 may be formed from a resonant cavity wall which contacts wall 24 of disk 32 or is spaced apart from wall 24.

As an applied coating, conductive wall 34 may be depicted in exaggerated thickness relative to the dimensions of disk 32 in the figures for clarity. Not only does coating 34 refrain from coating top and bottom ends 20 and 22, but no other conductor is permitted to contact top and bottom ends 20 and 22.

An axially aligned hole 36 penetrates into resonator 12 from the centers of top and bottom sides 20 and 22 and extends entirely through resonator 12 between sides 20 and 22. Resonator 12 has a cylinder diameter $D_c$. Cylinder diameter $D_c$ defines the diameter of dielectric disk 32, but conductive wall 34 may be sufficiently thin that diameter $D_c$ can also be viewed as the diameter of resonator 12. Hole 36 has a diameter $D_h$ that allows resonator 12 to be effective when$>0.1D_c$. However, the best size and quality factor results appear to occur when $0.21D_c \leqq D_h \leqq 0.4D_c$.

Conductive wall 34 is not extended within hole 36. The boundary of dielectric disk 32 within hole 36 and at top and bottom ends 20 and 22 is formed with a different dielectric material. The dielectric constants of these different boundary materials are desirably significantly less than dielectric constant $\epsilon_r$ of disk 32. These boundary materials include air 26 at top end 20 and potentially inside hole 36, screw 30 potentially inside hole 36, and substrate 16 and/or an adhesive at bottom end 22. Effective results are achieved when such boundary materials exhibit dielectric constants less than $0.5\epsilon_r$, but the most practical results occur when such materials exhibit dielectric constants less than five.

An axial length (L) defines the distance between top and bottom ends 20 and 22. Resonator 12 is configured so that cylinder diameter $D_c$ is roughly $0.5\lambda/\sqrt{\epsilon_r}$ or less and so that axial length L of resonator 12 is less than $0.5\lambda/\sqrt{\epsilon_r}$, where $\lambda$ is the wavelength of the lowest resonant frequency of resonator 12 in empty space. This configuration is accomplished in the manner discussed below in connection with FIGS. 4–6.

Figure 4:
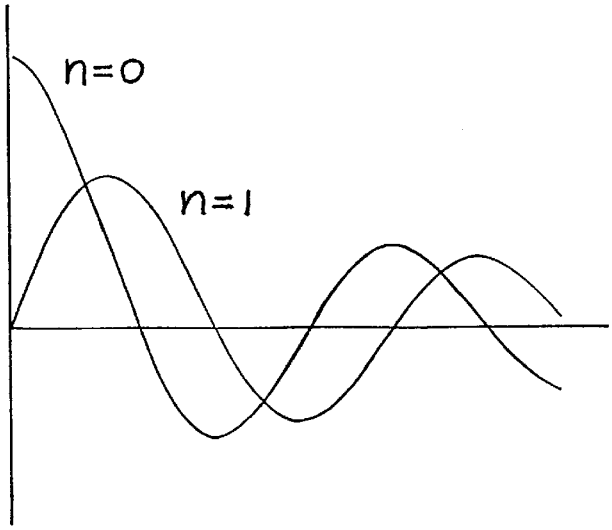
FIG. 4 shows curves for Bessel functions of the first kind.
Figure 5:
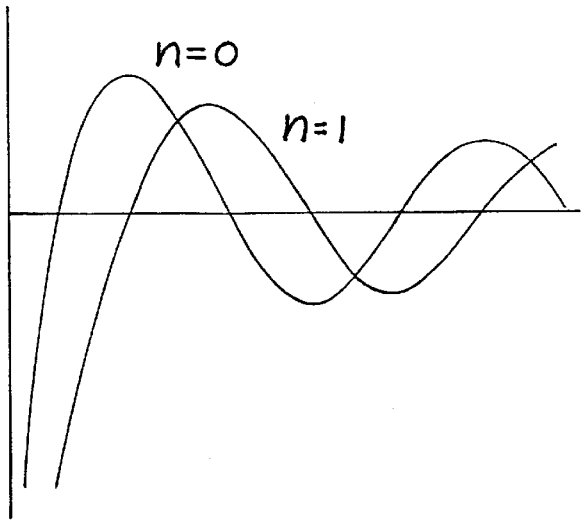
FIG. 5 shows curves for Bessel functions of the second kind.
Figure 6:
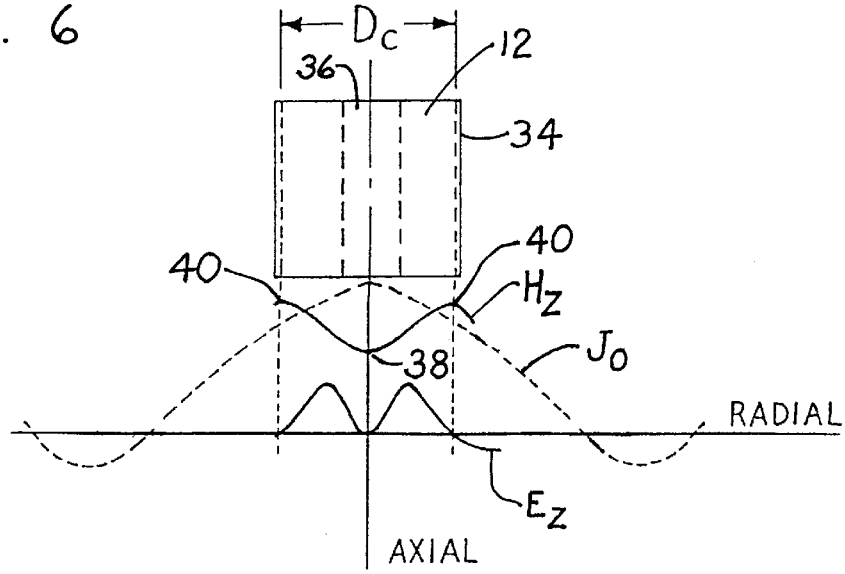
FIG. 6 shows exemplary curves which depict tangential magnetic and electric field intensities in the $TE_{0\gamma\delta}$ mode dielectric resonator as a function of radial distance.

FIG. 4 shows curves for Bessel functions of the first kind, FIG. 5 shows curves for Bessel functions of the second kind, and FIG. 6 shows exemplary curves which depict tangential magnetic and electric field intensities in the first embodiment of $TE_{0\gamma\delta}$ mode dielectric resonator 12 as a function of radial distance.

Referring to FIG. 4, Bessel functions of the first kind for n=0 and n=1 roughly depict normalized TE mode tangential magnetic and electric field intensities, respectively, in an axial direction of a high dielectric constant, cylindrical space as a function of radial distance for the cylindrical space. The high dielectric constant is evaluated relative to an empty space surrounding the cylindrical space. The axial direction is depicted in FIG. 4 along a vertical axis and the radial direction is depicted along a horizontal axis. The n=1 curve has zeros at the radial distances where the n=0 curve has maxima and minima. The cylindrical space may be provided by a solid, dielectric material having a cylindrical shape or by a cylindrical-shaped dielectric having an axially aligned hole of small diameter (e.g.<21%) relative to the diameter of the cylinder, such as provided by a conventional $TE_{01\delta}$ resonator.

TE resonant modes are supported at wavelengths that have predetermined relationships with the radial distance. For example, the radial distances at which the n=0 and n=1 curves exhibit zeros potentially support resonant modes. In accordance with the relationships depicted in FIG. 4, the lowest resonant frequency is potentially achieved in the smallest radial distance where the n=0 curve experiences its first zero. By configuring a dielectric disk so that a magnetic wall forms at or beyond the curved wall of the disk, a standing wave can be supported within the disk. In $TE_{01}$ mode resonators, this standing wave is confined within the resonator and exhibits zeros at radial distances at or within the walls of the resonator. The relationship between disk characteristics and wavelength for the lowest resonant frequency is known to those skilled in the art to be a function of disk dielectric constant, disk diameter, disk volume, and a constant based on the speed of light.

As an axially aligned hole of a disk resonator increases in size relative to the disk diameter, its influence over the magnetic and electric field intensities increases. In particular, FIG. 5 depicts Bessel functions of the second kind for n=0 and n=1 that roughly depict normalized TE mode tangential magnetic and electric field intensities, respectively, in an axial direction of a low dielectric constant cylindrical space as a function of radial distance. The low dielectric constant space is evaluated relative to a higher dielectric constant surrounding space. The axial direction is depicted in FIG. 5 along a vertical axis and the radial direction is depicted along a horizontal axis. The n=1 curve has zeros at the radial distances where the n=0 curve has maxima and minima. Accordingly, the second kind of Bessel functions depicted in FIG. 5 show magnetic and electric field intensities for a hole, such as hole 36 (FIGS. 1–3) formed in a disk. So long as the hole is small relative to the cylinder diameter, the influence is small, and the resulting field intensity performance resembles the curves depicted in FIG. 4.

As a first order approximation, the performance of resonator 12 is depicted in FIG. 6 by the combination of n=0 and n=1 curves from FIGS. 4 and 5. The n=0 curves from FIGS. 4 and 5 combine to generate an exemplary $H_z$ curve in FIG. 6, and the n=1 curves from FIGS. 4 and 5 combine to generate an exemplary $E_z$ curve in FIG. 6. The n=0 and n=1 curves are combined after appropriate scaling, which is a function of relative dielectric constants and relative hole sizes. Due to a wide range of possible variations in the $H_z$ and $E_z$ curves caused by this scaling, the actual field intensities of resonators 12 configured in accordance with the teaching of the present invention may resemble the FIG. 6 curves only in prominent features. For example, the $E_z$ curve experiences zeros at radial distances where the $H_z$ curve experiences maxima and minima.

Likewise, as depicted by FIG. 6, with dielectric constant $\epsilon_r>40$ and with hole diameter $D_h>0.1D_c$, a minimum 38 appears in the magnetic field intensity $H_z$ along the axis of resonator 12. For comparison purposes, FIG. 6 depicts the n=0, first kind of Bessel function from FIG. 4 as dotted line $J_0$. Minimum 38 causes maxima 40 to occur at a shorter radial distance than where $J_0$ experiences its first zero. Larger hole diameters $D_h$ and greater dielectric constants $\epsilon_r$ lead to a more pronounced dip between minimum 38 and maxima 40. In other words, larger hole diameters $D_h$ and greater dielectric constants $\epsilon_r$ increase the variation in axial intensity between minimum 38 and maxima 40 for a given radial distance from minimum 38 to maxima 40. More pronounced dips are preferred because they lead to higher quality factor parameters for resonator 12. For that reason, disk 32 preferably exhibits a dielectric constant $\epsilon_r$ less than 40 and a hole diameter $D_h$ greater than or equal to $0.21D_c$.

As hole diameter $D_h$ increases relative to cylinder diameter $D_c$, maxima 40 move radially outward. At around $D_h=0.4D_c$, maxima 40 reside at roughly the radial distance where curve $J_0$ exhibits its first zero. Accordingly, hole diameter $D_h$ is preferably less than or equal to $0.4D_c$ so that resonator 12 has a smaller size for a given lowest resonant frequency than would a corresponding conventional $TE_{01\delta}$ mode resonator having a small hole and exhibiting a magnetic field intensity exemplified by curve $J_0$.

As exemplified by curve $E_z$, the electric field intensity within resonator 12 at the lowest resonant frequency experiences zeros at maxima 40. In order to force this electric field intensity performance to occur, an electric wall is formed at curved wall 24 by the application of conductive wall 34. Accordingly, the dimensions of resonator 12, and particularly of cylinder diameter $D_c$, exert a large influence on the lowest resonant frequency for resonator 12. At the lowest resonant frequency, the electric wall imposed by conductive wall 34 forces the electric field intensity to equal zero at wall 24 of resonator 12.

The forcing of the electric field intensity to equal zero at wall 24 allows a standing wave to build within and without dielectric resonator 12 at a frequency having a wavelength determined by cylinder diameter $D_c$. Less than 0.5 of a wavelength and with preferential selection of hole diameter $D_h$ and dielectric constant $\epsilon_r$, less than 0.25 of a wavelength resides within resonator 12 in the radial direction at the lowest resonant frequency. Likewise, by forming a boundary with a low dielectric constant material at top and bottom ends 20 and 22, less then 0.5 of a wavelength resides within resonator 12 in the axial direction at the lowest resonant frequency. The result is a $TE_{0\gamma\delta}$ mode dielectric resonator with a smaller diameter than a corresponding $TE_{01\delta}$ dielectric resonator having the same lowest resonant frequency.

Figure 7:
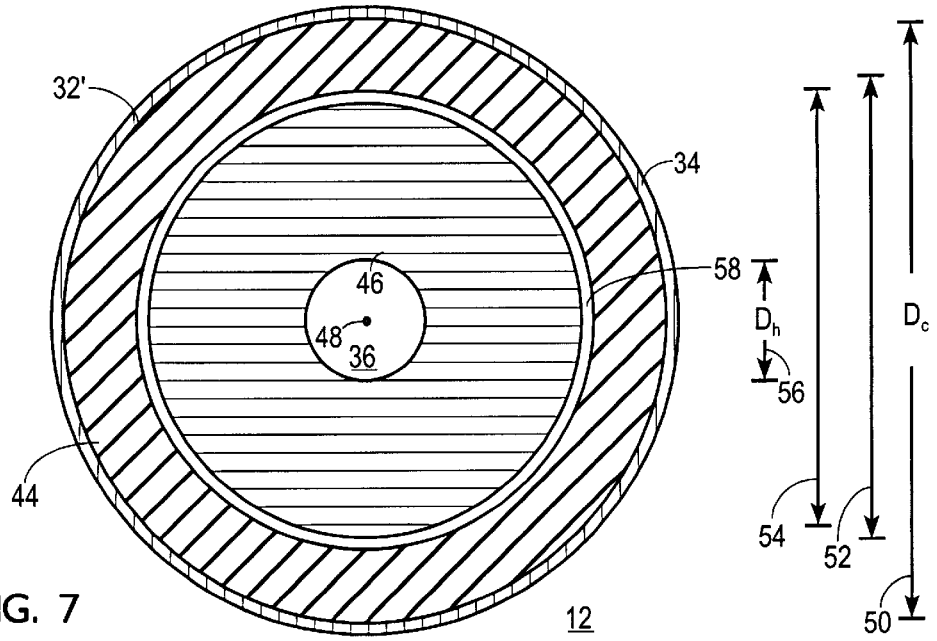
FIG. 7 shows a top view of a second embodiment of the $TE_{0\gamma\delta}$ mode dielectric resonator.

FIG. 7 shows a top view of a second embodiment of $TE_{0\gamma\delta}$ mode dielectric resonator 12. This second embodiment differs from the first embodiment discussed above in that homogeneous disk 32 is replaced in this second embodiment with a heterogeneous dielectric disk 32'. In particular, disk 32' is formed from outer and inner disks 44 and 46, respectively, each of which has axial holes therein. Inner disk 46 is located inside the hole of outer disk 44, and the above-discussed hole 36 of resonator 12 is formed in inner disk 46. Disks 44 and 46 are also referred to as rings 44 and 46 herein. Desirably, rings 44 and 46 are substantially coaxial, have substantially equivalent lengths along their common axis 48, and are positioned so that rings 44 and 46 are aligned at top and bottom ends 20 and 22 (FIG. 2) of heterogeneous disk 32'. The above-discussed dimensions $D_h$ and $D_c$ apply to this second embodiment in the same manner as discussed above.

Desirably, outer ring 44 is thinner than inner ring 46. Outer ring 44 has an outside diameter 50 and an inside diameter 52. The ratio of inside diameter 52 to outside diameter 50 is greater than 0.5 and preferably in the range of 0.7 to 0.9. Inner ring 46 has an outside diameter 54 and an inside diameter 56. The ratio of inside diameter 56 to outside diameter 54 is desirably greater than the equivalent ratio for outer ring 44.

An inter-ring gap 58 exists between outer ring 44 at its inside diameter 52 and inner ring 46 at its outside diameter 54. Gap 58 is provided to accommodate mechanical tolerance mismatches between outer ring 44 and inner ring 46. In addition, outer ring 44 and inner ring 46 are formed from dissimilar materials. Accordingly, gap 58 is dimensioned to accommodate diverse thermal expansion characteristics of the dissimilar materials. Allowing for these two considerations, gap 58 is desirably as small as possible, and is illustrated in an exaggerated form in the Figures for clarity.

Desirably, gap 58 is occupied by a dielectric material that exhibits a dielectric constant less than 0.5 $\epsilon_{re}$, where $\epsilon_{re}$ is the effective dielectric constant of disk 32' across outer ring 44 and inner ring 46. This effective dielectric constant $\epsilon_{re}$ is roughly the average of the dielectric constants $\epsilon_r$ of the dissimilar materials. Effective dielectric constant $\epsilon_{re}$ is used herein to refer to homogeneous and heterogeneous dielectric resonator disks 32, 32' and the like, and not to air or other low dielectric constant material gaps which may be present in resonator 12. In the preferred embodiments, gap 58 is occupied by a thermally conductive glue which serves to bond outer and inner rings 44 and 46 together and promote heat transfer.

The material from which outer ring 44 is formed has a particularly high dielectric constant $\epsilon_r$, even at the cost of accepting an undesirably low Q. In the preferred embodiment, this material desirably has an $\epsilon_r$ greater than 40 and preferably greater than 70, even though the Q of such a material may be on the order of around 3000. However, a balance of high dielectric constant and high Q is desired. In contrast, the material from which inner ring 46 is formed has a significantly higher Q than that of outer ring 44, even at the cost of a lower $\epsilon_r$. In the preferred embodiment, this inner ring material desirably has a Q on the order of 30,000 or more, even though the $\epsilon_r$ of such a material may be less than 40.

Figure 8:
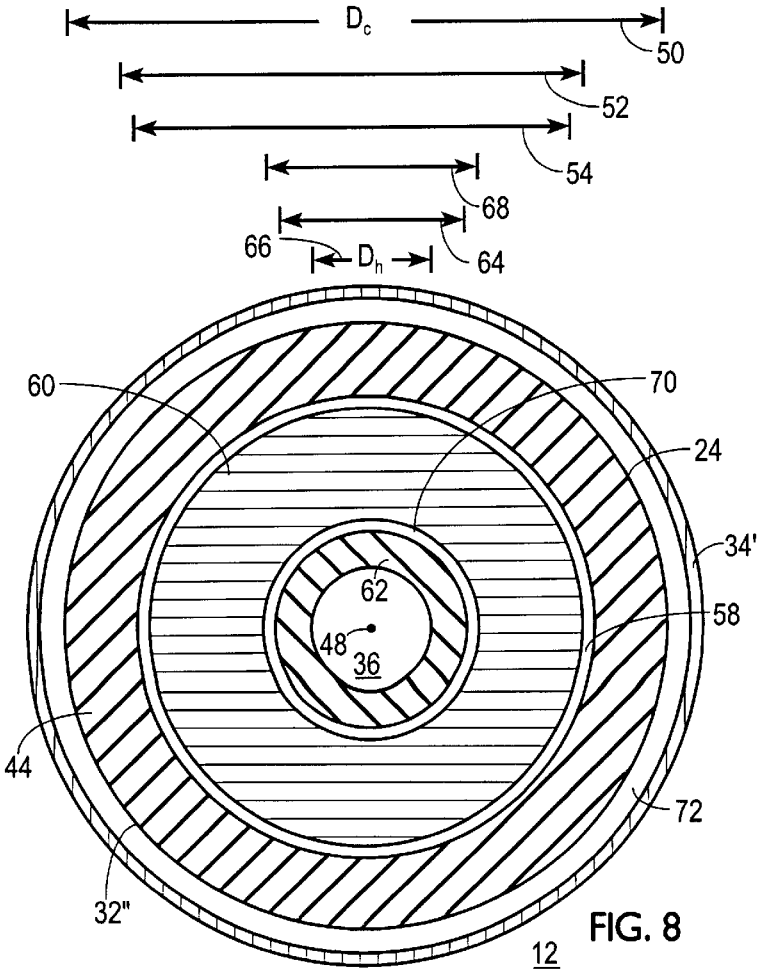
FIG. 8 shows a top view of a third embodiment of the $TE_{0\gamma\delta}$ mode dielectric resonator.

FIG. 8 shows a top view of a third embodiment of $TE_{0\gamma\delta}$ mode dielectric resonator. This third embodiment differs from the first and second embodiments discussed above in that homogeneous disk 32 (FIG. 2) or heterogeneous disk 32' (FIG. 7) is replaced in this third embodiment with a heterogeneous dielectric disk 32" and in that disk 32" is placed in a conductive housing so that a conductive wall 34' is not applied as a coating to disks 32 and 32' (FIGS. 3 and 7) but is spaced away from side wall 24 of disk 32".

Heterogeneous disk 32" differs from heterogeneous disk 32' (FIG. 7) in that inner disk 46 of disk 32' (FIG.7) is replaced by a middle disk 60 and an innermost disk 62. Outer disk 44 remains configured as discussed above. Middle disk 60 and innermost disk 62 each have axial holes therein. Innermost disk 62 is located inside the hole of middle disk 60, and the above-discussed hole 36 of resonator 12 is formed in innermost disk 62. Disks 60 and 62 are also referred to as rings 60 and 62 herein. Desirably, rings 60 and 62 are substantially coaxial, have substantially equivalent lengths along their common axis 48, and are positioned so that rings 44, 60 and 62 are aligned at top and bottom ends 20 and 22 (FIG. 2) of heterogeneous disk 32". The above-discussed dimensions $D_h$ and $D_c$ apply to this third embodiment in the same manner as discussed above.

Desirably, innermost ring 62 is thinner than middle ring 60. Innermost ring 62 has an outside diameter 64 and an inside diameter 66. The ratio of inside diameter 66 to outside diameter 64 is greater than 0.5 and preferably in the range of 0.7 to 0.9. Accordingly, innermost ring 62 has an aspect ratio similar to that of outer ring 44. Middle ring 60 has an outside diameter 54 and an inside diameter 68. The ratio of inside diameter 68 to outside diameter 54 is desirably greater than the equivalent ratio for either outer ring 44 or innermost ring 62. An inter-ring gap 70 exists between middle ring 60 at its inside diameter 68 and innermost ring 62 at its outside diameter 64. Gap 70 is desirably configured similarly to gap 58.

In this third embodiment, middle ring 60 is formed from the same material as inner ring 46 of the second embodiment (FIG. 7). Thus, middle ring 60 exhibits a significantly higher Q than outer ring 44 but a lower dielectric constant $\epsilon_r$. Innermost ring 62 is formed from a material that is dissimilar to the materials from which either outer ring 44 or middle ring 60 is formed. The material selected for innermost ring 62 desirably exhibits a lower $\epsilon_r$ than that of middle and outer rings 60 and 44, but still desirably greater than $0.5\epsilon_r$ of middle ring 60. In the preferred embodiment, $\epsilon_r$ of innermost ring 62 is desirably less than 30, but less than or equal to the $\epsilon_r$ of middle ring 60 in any event. The Q of such a material may well exceed 40,000.

The positioning of conductive walls 34' relative to heterogeneous disk 32" in this third embodiment could likewise be applied to homogeneous disk 32 (FIG. 3) or heterogeneous disk 32' (FIG. 7). Accordingly, mention of disk 32 below will refer to any of disks 32, 32' or 32". Unlike a conventional $TE_{01\delta}$ resonator, the lowest resonant frequency of resonator 12 increases as conductive walls 34' are positioned further away from side wall 24 of disk 32. Accordingly, in order to get the lowest resonant frequency in the smallest package, conductive walls 34' are desirably juxtaposed as close to side wall 24 as possible. However, as conductive walls 34' are moved closer to side wall 24, Q drops. Accordingly, conductive walls 34' are positioned to balance these two opposing considerations. Moreover, in order to achieve $TE_{0\gamma\delta}$ mode resonance, conductive walls 34' are desirably positioned a radial distance away from axis 48 less than $0.25\lambda/\sqrt{\epsilon_{re}}$, where $\epsilon_{re}$ is the effective dielectric constant for disk 32. A gap 72 which may form between disk 32 and conductive wall 34' is desirably occupied with a dielectric material exhibiting a dielectric constant $<0.5\epsilon_{re}$, such as air or a suitable dielectric spacer.

As discussed above, diameter $D_c$ of disk 32 (FIGS. 2, 3 and 6) is preferably less than $0.5\lambda/\sqrt{\epsilon_{re}}$ when conductive wall 34 is applied as a coating to side wall 24 of disk 32. Accordingly, the radial distance of conductive wall 34 is preferably less than $0.25\lambda/\sqrt{\epsilon_{re}}$ away from axis 48 when conductive wall 34 is applied as a coating to side wall 24. When conductive wall 34' is spaced apart from disk 32 by gap 72, the diameter $D_c$ of disk 32 may increase a small amount to hold the same lowest resonant frequency. Accordingly, the maximum distance of conductive wall 34' away from axis 48 is less than $0.75\lambda/\sqrt{\epsilon_{re}}$ and preferably less than $0.6\lambda/\sqrt{\epsilon_{re}}$. Even by spacing conductive wall 34' its maximum distance away from axis 48 while still achieving $TE_{0\gamma\delta}$ mode resonance, the overall size of resonator 12 is less than otherwise equivalent $TE_{01\delta}$, and $TM_{01\delta}$ mode resonators.

Figure 9:
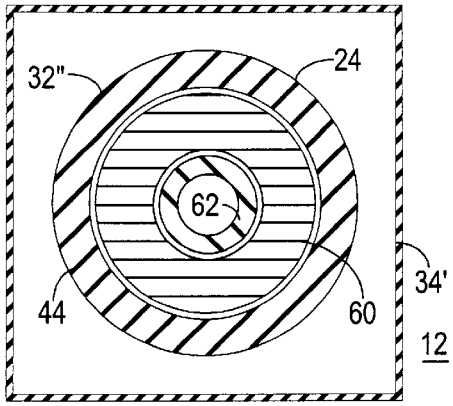
FIG. 9 shows a top view of a fourth embodiment of the $TE_{0\gamma\delta}$ mode dielectric resonator.

FIG. 9 shows a top view of a fourth embodiment of $TE_{0\gamma\delta}$ mode dielectric resonator 12. This fourth embodiment differs from the third embodiment of FIG. 8 in that conductive walls 34' are formed by a conductive housing that has a square cross-sectional shape rather than a round or cylindrical shape. The maximum spacing of conductive walls 34' from disk side wall 24 is measured at the closest point between walls 34' and side wall 24. While this fourth embodiment provides some slight degradation in performance compared to the third embodiment of FIG. 8, the square-shaped housing of FIG. 9 achieves sufficient manufacturing cost savings over the cylindrical housing of FIG. 8 to justify the degradation in some applications, particularly when resonator 12 is configured to operate at lower resonant frequencies.

Figure 10:
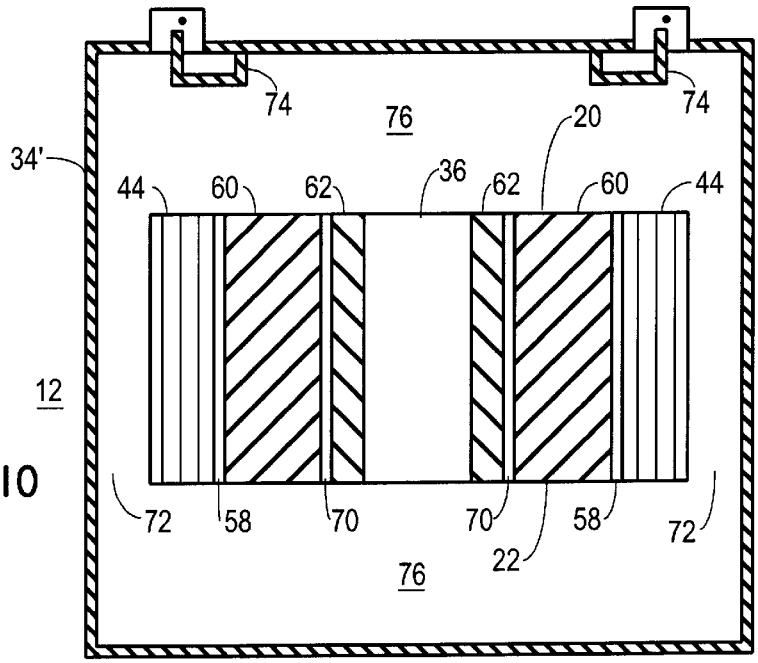
FIG. 10 shows a side view of the $TE_{0\gamma\delta}$ mode dielectric resonator shown in FIG. 8.

FIG. 10 shows a side view of the third embodiment of $TE_{0\gamma\delta}$ mode dielectric resonator 12, the top view of which is shown in FIG. 8. As illustrated in FIGS. 8 and 10, conductive walls 34' may be extended to completely enclose disk 32 in a resonant cavity. Input and output signals may be provided via probes 74 or suitable slots (not shown). As shown in FIG. 10, conductive walls 34' extend far beyond top and bottom ends 20 and 22, and are capped off to completely enclose disk 32 within a resonant cavity that has an air or other low dielectric constant (i.e. less than $0.5\epsilon_{re}$) material gaps 76 above and below disk 32.

In order to achieve $TE_{0\gamma\delta}$ mode resonance, no conductive walls are positioned closer than $0.25\lambda/\sqrt{\epsilon_{re}}$ from top and bottom ends 20 and 22 of disk 32. Accordingly, conductive walls 34' are positioned relative to disk 32 so that gaps 76 extend for a distance of at least $0.25\lambda/\sqrt{\epsilon_{re}}$.

Figure 11:
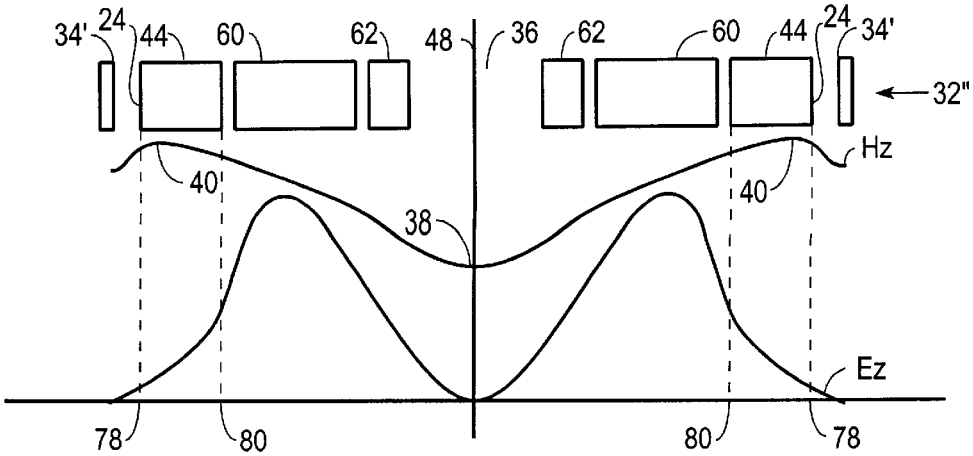
FIG. 11 shows exemplary curves which depict tangential magnetic and electric field intensities in the $TE_{0\gamma\delta}$ mode dielectric resonator as a function of radial distance for the $TE_{0\gamma\delta}$ mode dielectric resonator shown in FIG. 8.

FIG. 11 shows exemplary curves which depict tangential magnetic and electric field intensities in $TE_{0\gamma\delta}$ mode dielectric resonator 12 as a function of radial distance for the third embodiment of resonator 12 shown in FIG. 8. As discussed above in connection with FIG. 6, due to a wide range of possible variations in the $H_z$ and $E_z$ curves, the actual field intensities of resonators 12 configured in accordance with the teaching of the present invention may resemble the FIG. 11 curves only in prominent features.

In comparing the curves of FIG. 11 with those of FIG. 6, maxima 40 again occur at the outer edge of disk 32", but are shifted slightly inside disk 32 from wall 24 in this third embodiment. Since the $H_z$ field tends to pool in materials with high $\epsilon_r$, the positions maxima 40 are stable within outer ring 44 of disk 32".

The high dielectric constant $\epsilon_r$ of outer ring 44 provides a prominent contribution to raising the effective dielectric constant $\epsilon_{re}$ and reducing the wavelength at resonance within disk 32". Accordingly while heterogeneous disk 32" may be larger than homogeneous disk 32 (FIG. 3), other factors remaining the same, the increase in size is modest due to this prominent contribution of outer ring 44.

In lower Q materials the $E_z$ field experiences more attenuation than in higher Q materials. Unfortunately, commercially practical dielectric materials having high dielectric constants $\epsilon_r$ tend to exhibit lower Q's than desired. The thickness of outer ring 44 is indicated in FIG. 11 between vertical dotted lines 78 and 80. In this region, the $E_z$ field is nearly zero due to TE mode oscillation and the proximity of conductive wall 34'. Accordingly, the exaggerated attenuation of the $E_z$ field experienced in this lower Q region is not nearly as pronounced as it would be if it were applied where the $E_z$ field reaches a maximum. Rather, the higher Q material of middle ring 60 is applied where the $E_z$ field reaches a maximum.

Optional innermost ring 62 exhibits a lower $\epsilon_r$ than riddle ring 60 to provide enhanced mode separation. The $H_{E11}$ mode resonance, which is at a higher frequency than the $TE_{0\gamma\delta}$ mode resonance, becomes lower as the dielectric constant $\epsilon_r$ in the center of disk 32" increases. Accordingly, by slightly lowering $\epsilon_r$ in the center of disk 32" the separation between the $TE_{0\gamma\delta}$ mode and the $H_{E11}$ modes increases.

In summary, the present invention provides an improved $TE_{0\gamma\delta}$ mode dielectric resonator. This $TE_{0\gamma\delta}$ mode dielectric resonator achieves suitably high Q in a smaller space than required by a conventional $TE_{01\delta}$ mode or $TM_{01\delta}$ mode dielectric resonator. A relatively large hole in a cylindrical dielectric resonator, preferably greater than 0.21 times the diameter of the resonator, and a conductive wall cause a fractional resonant mode in the radial direction. A heterogeneous or composite dielectric resonator, optionally in conjunction with a conductive housing, may achieve a high Q while maintaining a small size for the resonator. In the preferred embodiment, a Q approaching 10,000 is achieved in a resonator having conductive housing with a diameter less than $1.2\lambda/\sqrt{\epsilon_{re}}$.

The present invention has been described above with reference to preferred embodiments. However, those skilled in the art will recognize that changes and modifications may be made in these preferred embodiments without departing from she scope of the present invention. Such changes and modifications which are obvious to those skilled in the art are intended to be included within the scope of the present invention.

What is claimed is:

1. A resonator configured to resonate in the $TE_{0\gamma\delta}$ mode at a lowest resonant frequency having a wavelength $\lambda$ in empty space, said resonator comprising:

a dielectric resonator disk configured to exhibit an effective dielectric constant $\epsilon_{re}$, said disk having first and second opposing ends along an axis and a closed curve wall surrounding said axis and extending between said first and second ends, said disk having a hole penetrating therein from said first end and extending toward said second end, wherein at least one of said first and second ends serves as a boundary between said disk and a dielectric material having a dielectric constant less than $0.5\epsilon_{re}$; and a conductive wall juxtaposed with said curved wall of said disk and positioned less than $0.75\lambda/\sqrt{\epsilon_{re}}$ from said axis.

2. A resonator as claimed in claim 1 wherein:

said hole extends through said disk from said first end to said second end;

said disk is shaped as a cylinder having a diameter D; and said hole exhibits a diameter greater than 0.1D.

3. A resonator as claimed in claim 2 wherein said hole exhibits a diameter greater than 0.21D.

4. A resonator as claimed in claim 3 wherein said hole exhibits a diameter less than 0.4D.

5. A resonator as claimed in claim 1 wherein said dielectric material having a dielectric constant less than $0.5\epsilon_{re}$ extends away from said boundary for a distance of at least $0.25\lambda/\sqrt{\epsilon_{re}}$.

6. A resonator as claimed in claim 1 wherein no conductive wall is positioned closer than $0.25\lambda/\sqrt{\epsilon_{re}}$ from said first or second ends of said disk.

7. A resonator as claimed in claim 1 wherein said conductive wall is positioned less than $0.6\ \lambda/\sqrt{\epsilon_{re}}$ from said axis.

8. A resonator as claimed in claim 1 wherein said disk has an axial length of less than $0.5\lambda/\sqrt{\epsilon_{re}}$.

9. A resonator as claimed in claim 1 wherein said disk is comprised of first and second rings which exhibit different dielectric constants and different quality factors (Q).

10. A resonator as claimed in claim 9 wherein:

said first ring is concentric with and resides outside of said second ring;

said first and second rings each have inside and outside diameters; and the ratio of said inside diameter of said first ring to said outside diameter of said first ring is less than the ratio of said inside diameter of said second ring to said outside diameter of said second ring.

11. A resonator as claimed in claim 9 wherein:

said first ring resides outside of said second ring; and said first ring exhibits a higher dielectric constant than said second ring.

12. A resonator as claimed in claim 9 wherein said disk additionally comprises a third ring which exhibits a different dielectric constant and quality factor (Q) from the dielectric constants and quality factors (Q) of said first and second rings.

13. A resonator as claimed in claim 9 wherein:

said first ring is concentric with and resides outside of said second ring;

an inter-ring gap exists between said first and second rings; and said inter-ring gap is occupied by a dielectric material having a dielectric constant$<0.5\epsilon_{re}$.

14. A resonator configured to resonate in the $TE_{0\gamma\delta}$ mode at a lowest resonant frequency having a wavelength $\lambda$ in empty space, said resonator comprising:

a composite dielectric disk having first and second dielectric rings which have a common axis with said first ring being located outside said second ring, said first dielectric ring exhibiting a greater dielectric constant than said second ring and said first and second rings collectively exhibiting an effective dielectric constant $\epsilon_{re}$, said first ring having an outside diameter D, and said second ring having an axially aligned interior hole occupied by a material exhibiting a dielectric constant less than $0.5\epsilon_{re}$ and exhibiting a diameter greater than or equal to 0.21D but less than or equal to 0.4D; and a conductive wall circumferentially surrounding said composite dielectric disk and positioned less than $0.75\lambda/\sqrt{\epsilon_{re}}$ from said axis.

15. A resonator having a lowest resonant frequency with a wavelength $\lambda$ in empty space and an effective dielectric constant $\epsilon_{re}$, said resonator comprising:

a first dielectric resonator disk formed from a first material which exhibits a first dielectric constant and a first quality factor (Q), having a hole therein, and having a closed curve wall surrounding an axis of said first disk;

a conductive wall surrounding said first disk and positioned less than $0.75\lambda/\sqrt{\epsilon_{re}}$ from said axis; and a second dielectric resonator disk located inside said hole of said first dielectric resonator disk, said second disk being formed from a second material which exhibits a second dielectric constant and a second quality factor (Q).

16. A resonator as claimed in claim 15 wherein:

said first disk has an outside diameter D; and said second disk has an axially aligned hole therein, said second disk hole being occupied by a material exhibiting a dielectric constant less than $0.5\epsilon_{re}$ and exhibiting a diameter greater than or equal to 0.21D but less than or equal to 0.4D.

17. A resonator as claimed in claim 15 wherein each of said first and second disks has an axial length of less than $0.5\lambda/\sqrt{\epsilon_{re}}$.

18. A resonator comprising:

a first dielectric resonator disk having a hole therein, said first disk being formed from a first material which exhibits a first dielectric constant and a first quality factor (Q);

a second dielectric resonator disk having a hole therein and located inside said hole of said first dielectric resonator disk, said second disk being formed from a second material which exhibits a second dielectric constant and a second quality factor (Q); and a third dielectric resonator disk positioned inside said hole of said second disk, said second disk exhibiting a higher dielectric constant than said third disk.

19. A resonator as claimed in claim 18 wherein:

said first disk exhibits a dielectric constant greater than 40; and said second disk exhibits a dielectric constant less than 40.

20. A resonator comprising:

a first dielectric resonator disk having a hole therein, said first disk being formed from a first material which exhibits a first dielectric constant and a first quality factor (Q);

a second dielectric resonator disk located inside said hole of and concentric with said first disk, said second disk having a hole therein and being formed from a second material which exhibits a second dielectric constant and a second quality factor (Q);

said first and second disks each have inside and outside diameters; and the ratio of said inside diameter of said first disk to said outside diameter of said first disk is less than the ratio of said inside diameter of said second disk to said outside diameter of said second disk.

21. A resonator comprising:

a first dielectric resonator disk having a hole therein, said first disk being formed from a first material which exhibits a first dielectric constant and a first quality factor (Q);

a second dielectric resonator disk having a hole therein and located inside said hole of said first dielectric resonator disk, said second disk being formed from a second material which exhibits a second dielectric constant and a second quality factor (Q); and a third dielectric resonator disk located within said hole of said second disk, said third disk exhibiting a different dielectric constant and quality factor (Q) from the dielectric constants and quality factors (Q) of said first and second disks.

* * * * *